United States Patent [19]

Wu et al.

[11] 4,119,149

[45] Oct. 10, 1978

[54] RECOVERING PETROLEUM FROM SUBTERRANEAN FORMATIONS

[75] Inventors: Ching H. Wu, Golden, Colo.; Alfred Brown, Houston; Wilbur L. Hall, Bellaire, both of Tex.

[73] Assignee: Texaco Inc., New York, N.Y.

[21] Appl. No.: 752,642

[22] Filed: Dec. 20, 1976

[51] Int. Cl.[2] ..... E21B 43/24

[52] U.S. Cl. ..... 166/266; 166/267; 166/272

[58] Field of Search ..... 166/265, 266, 267, 272, 166/303

[56] References Cited

U.S. PATENT DOCUMENTS

| | | | |
|---|---|---|---|
| 2,319,702 | 5/1943 | Moon | 166/265 |
| 2,386,036 | 10/1945 | Cross | 166/266 |
| 2,412,765 | 12/1946 | Buddrus et al. | 166/267 X |
| 2,862,558 | 12/1958 | Dixon | 166/272 |
| 3,228,467 | 1/1966 | Schlinger et al. | 166/266 |
| 3,259,186 | 7/1966 | Dietz | 166/272 X |
| 3,351,132 | 11/1967 | Dougan et al. | 166/272 X |
| 3,768,559 | 10/1973 | Allen et al. | 166/272 |
| 3,796,262 | 3/1974 | Allen et al. | 166/272 |
| 3,945,435 | 3/1976 | Barry | 166/267 |

FOREIGN PATENT DOCUMENTS

| | | | |
|---|---|---|---|
| 985,640 | 3/1965 | United Kingdom | 166/272 |

*Primary Examiner*—Stephen J. Novosad
*Assistant Examiner*—George A. Suchfield
*Attorney, Agent, or Firm*—Carl G. Ries; Thomas H. Whaley; Douglas H. May, Jr.

[57] ABSTRACT

A process for enhanced recovery of petroleum from subterranean formations is disclosed, wherein steam is injected into a formation via an injection well, and a mixture of petroleum and steam condensate is produced via a production well, wherein the produced mixture is flashed for production of a steam-distilled hydrocarbon fraction, and wherein the steam distilled hydrocarbon fraction is injected, with additional steam, into a subterranean formation for increased recovery of petroleum. The process disclosed is particularly useful in recovery of heavy (low API gravity) petroleum.

7 Claims, No Drawings

RECOVERING PETROLEUM FROM SUBTERRANEAN FORMATIONS

The present invention relates to recovery of petroleum from subterranean formations. Particularly, it relates to recovering relatively heavy petroleum oils or tar sands bitumen from consolidated or unconsolidated subterranean formations employing a method wherein light hydrocarbon fractions, steam distilled from produced crude petroleum, are reinjected with steam into the subterranean formations via injection wells, and wherein produced crude, steam, and reinjected light hydrocarbons are recovered from wells producing from the same subterranean formations.

It is known, generally, to produce petroleum oils, tar sand bitumens, and related petroleum hydrocarbons from shale, sandstone, unconsolidated sand, and other subterranean formations by injecting steam into a first well for heating the petroleum in such formations and forcing such petroleum to a second well from which such petroleum is produced. In this method of recovering heavy petroleum from subterranean formations, a bank of petroleum builds up in a cold zone ahead of the advancing steam. This bank of petroleum restricts flow through the formation, requiring high pressures for moving the petroleum to the producing well.

An improvement to the process of recovering petroleum employing steam injection was proposed in U.S. Pat. No. 2,862,558 granted Dec. 2, 1958 to Henry O. Dixon. In Dixon, a vapor mixture of superheated steam and a normally liquid hydrocarbon solvent are injected, via an injection well, into a subterranean formation for forcing petroleum to a second well from which such petroleum is produced. Hydrocarbon solvents contemplated by Dixon are those which, when admixed with petroleum to be produced, will reduce the viscosity of the mixture considerably below that of the petroleum in place. Such solvents will ordinarily have the characteristics of such liquids as kerosine, gasoline, jet fuel, stoddard solvent, benzene, xylene, toluene, etc. The advantages of the Dixon process is, injected hydrocarbon solvent mixes with the petroleum in place, lowering its viscosity. The lower viscosity mixture then travels through the formation to the producing well more rapidly, without building up a bank of petroleum in a cooler zone ahead of the advancing steam.

SUMMARY OF THE INVENTION

Now, according to the present invention, we have discovered an improved method for recovering petroleum from subterranean formations.

In one embodiment of the present invention, the improved process comprises:

a. injecting steam into a petroleum containing formation via at least one injection well;

b. producing petroleum from said petroleum containing subterranean formation via at least one production well;

c. continuing said steam injection and said petroleum production for a time sufficient to establish communication between said injection well and said production well such that a mixture of petroleum and steam condensate enters said production well;

d. flashing, in a flash zone, said mixture of petroleum and steam condensate for production of a liquid phase comprising petroleum and a vapor phase comprising steam and hyrocarbon vapor;

e. condensing, in a condenser, said vapor phase for producing a condensate comprising water and liquid hydrocarbon;

f. separating, in a gravity separation zone, said condensate into a water phase and a hydrocarbon phase;

g. injecting said hydrocabon phase, with additional steam into said injection well for displacing additional petroleum from the formation.

In one alternative, the total condensate of step (e), comprising water and steam distilled hydrocarbon, may be reinjected with additional steam into the subterranean formation. In this alternative, the condensing step (d) may be dispensed with, and the flashed vapor mixed directly with the steam, by means such as a jet pump.

Under certain conditions, when the produced fluid is sufficiently hot, flashing of water vapor and steam distilled hydrocarbons can occur in the well bore of the producing well. In such situations, vapor from the producing well head may be recovered directly for obtaining steam distilled hydrocarbons suitable for reinjection into the subterranean formation.

For situations where the produced petroleum is not sufficiently hot for flashing of a vapor comprising steam distilled hydrocarbon and steam, additional heat may be added to the produced liquid prior to flashing. Such heat may be added by indirect heat exchange means. Preferably, however steam is added directly to the produced petroleum in the flash zone for increasing the amount of steam distilled hydrocarbons produced.

Advantages of the process of the present invention over processes of the prior art include: increased displacement of petroleum from a subterranean formation employing injected mixture of steam and the light hydrocarbon which is steam distilled from the produce petroleum, as compared to petroleum displacement obtained using steam-hydrocarbon mixtures of the prior art. Also, the light hydrocarbon for injection with steam to enhance production of petroleum is obtained at the site, and expensive hydrocarbon solvents from external sources are not required. These, and other advantages of the process of the present invention will be discussed in the detailed description of the invention which follows.

DETAILED DESCRIPTION OF THE INVENTION

When steam flooding a petroleum bearing reservoir, a steam front, comprising a bank of condensed hot water, is often propagated from the injection well towards the producing well. As the steam front propagates, steam distillation takes place in the steam zone behind the steam front, evaporating light hydrocarbon fractions of the crude oil. Continuous steam distillation behind the steam front enriches the hydrocarbon content in the steam phase. Contemporaneously, due to the condensation of the light hydrocarbon vapors ahead of the steam front, a region of solvent bank will be established. When the steam front reaches the producing well, the light hydrocarbons in the solvent bank will be produced to the surface together with the displaced crude oils. At the producing wellbore, the steam distillation efficiency is further increased due to reduced pressure (compared to formation pressure) within the wellbore. Such pressure reduction will induce steam distillation conditions and light hydrocarbons will be evaporated with steam. Consequently, a large amount of light hydrocarbons will be produced with the produced steam. For example, the ratio of light hydrocarbons to steam which can be obtained from crude oil produced under steam flood conditions has been experimentally determined, and are shown in Table I, below:

TABLE I

| Crude Oil | Gravity | Wellbore Pressure (psig) | (kPa) | Temperature Produced Fluid ° F | ° C | Steam Condition in wellbore | Liquid volume ratio: light hydrocarbon/steam |
|---|---|---|---|---|---|---|---|
| San Ardo | 14 | 500 | 3548 | 471 | 244 | Saturated | 0.003–0.018 |
| San Ardo | 14 | 500 | 3548 | 600 | 316 | Superheated | 0.009–0.368 |
| Athabasca bitumen | 9 | 200 | 1482 | 387 | 197 | Saturated | 0.000–0.037 |
| Salem | 34 | 200 | 1482 | 387 | 197 | Saturated | 0.006–1.094 |

Thus, from Table I it is seen that a substantial amount of light hydrocarbon condensate may be obtained from the vapor produced from a production wellbore in the situation where petroleum is being produced under steam flood conditions and wherein the steam front has reached the production well.

We have discovered that this steam distilled light hydrocarbon fraction of the produced crude oil has superior solvent properties for enhancing production of additional petroleum when such light hydrocarbon is reinjected with additional steam into a subterranean formation. This discovery forms the basis of our invention.

Petroleum bearing formations for which the process of the present invention is useful include those which may be produced employing steam flooding techniques. Particularly, the present invention may be applied to petroleum formations which are depressured or underpressured, formations containing relatively heavy (low gravity) petroleum deposits, tar sands or other bitumen containing formations, and formations near the earth's surface which will not contain high pressures.

The temperature of the steam and steam distilled light hydrocarbon injected into a subterranean formation for enhancing recovery of petroleum is selected to carry sufficient heat into the formation to produce an advancing steam front with the associated solvent hydrocarbon bank. The temperature of the injected mixture will be sufficient to maintain a steam phase at formation pressures, and usually will be sufficient to provide some superheat at injection pressures. For example, temperatures of about 225° F. may be used for formations at about atmospheric pressure, and temperatures in the range of 470°–600° F. may be used in formations with pressures of about 500 psig. Such temperatures of injected steam and light hydrocarbon may be adjusted for the injection pressure of a particular subterranean formation from which petroleum is to be produced.

The proportion of light hydrocarbon to steam in the injected mixture may vary over a relatively large range of liquid volume ratios of about 1:1 to about 1:100 light hydrocarbon to steam respectively.

When light hydrocarbon comprises a large proportion of the injected vapor, the solvent power for reducing viscosity of petroleum in the formation is increased such that the petroleum will flow more readily toward the production well. However, the amount of heat per volume of injected vapor is decreased. When light hydrocarbon comprises a very small proportion of the injected vapors, its solvent power is substantially curtailed. Consequently, liquid volume ratios of hydrocarbon to steam in the injected vapor in the range of about 1:10 to about 1:50 respectively are preferred for providing a good balance of heat input and amount of solvent per volume of injected vapor for enhancing production of petroleum from the formation. Most preferred is a liquid volume ratio of light hydrocarbon to steam about 1:20 respectively in the injected vapor.

In the process of the present invention, the hydrocarbon may be injected along with steam at commencement of the steam flood; may be injected after the steam front has reached the production well; or may be injected when the steam front is in an intermediate position between the injection well and the production well.

When the hydrocarbon is injected at commencement of steam flooding, a solvent bank will accumulate rapidly, improving recovery of petroleum. However, the accumulated solvent bank may increase pressure drop through the formation, thus requiring increased injection pressure to drive the petroleum to the production well.

When the hydrocarbon is injected after the steam front has reached the production well, a substantial proportion of the petroleum will have been produced by steam flooding alone and the formation temperature will be increased. Thus, the solution of light hydrocarbon with remaining petroleum will be increased and the viscosity of the resulting solution will be decreased.

Recovery of a steam distilled hydrocarbon fraction, having superior properties over other hydrocarbon fractions for recovery of additional petroleum, may be obtained directly from the production wellbore in the case where the steam front has reached the production well or may be recovered from produced crude by steam distillation techniques. In either case, the steam distilled hydrocarbon fraction exhibits improved ability to produce additional petroleum, and is advantageously produced at the site.

The discussion thus far has been in terms of reinjecting the steam distilled hydrocarbon fraction into an injection well associated with a productio well from which the hydrocarbon fraction is obtained. It is to be understood that all or a part of such steam distilled hydrocarbon fraction may also be injected into another injection well for the same benefits of enhanced production of petroleum. Also, within contemplation of the present invention is the situation where one injection well serves two or more production wells.

The total volume of light hydrocarbon injected into a subterranean formation according to the method of the present invention is sufficient to result in increased production of petroleum from the formation, and will be proportional to the pore volume (porosity [$\phi$] times volume of the formation) and the total volume of the formation swept by the injected light hydrocarbon-steam mixture flowing to the production well. For practical increased petroleum recoveries, the total injected volume of light hydrocarbon should be in the range of 1–100 percent of the total pore volume in that portion of a formation swept by the hydrocarbon-steam mixture. Preferably, the total amount of hydrocarbon injected will be in the range of about 5–20 percent of the total pore volume in that portion of a formation swept by the light hydrocarbon-steam mixture. Should the total volume of injected hydrocarbon be less than 1 percent of the total swept pore volume, no substantial increase in petroleum production will occur over that obtained by steam flooding alone. Use of a total volume of injected hydrocarbon exceeding 100 percent of the total swept pore volume will not be economically justified by an increased production of petroleum.

A series of laboratory test were performed to demonstrate the utility of the process of the present invention for recovering relatively heavy petroleum from earth formations. Comparison tests, using steam flooding and using flooding with mixtures of steam and narrow boiling range hydrocarbons known to the prior art were also performed to demonstrate the advantages of the process of the present invention compared to processes of the prior art. These laboratory tests are described, and their results reported in the following examples.

EXAMPLE I

In this example Aurignac crude oil (14.9° API), from the San Ardo field, was recovered from laboratory sand packs employing (a) the process of the present invention; (b) a steam flooding process; (c) a process of flooding with a mixture of $C_5$–$C_6$ naphtha and steam; and (d) a process of flooding with steam and a mixture of propane and pentane in a mole ratio of 23:77 respectively. Results, reported below, indicate that substantially more oil was recovered employing the process of the present invention, compared to the other flooding processes.

Four sand packs were prepared in linear sand pack cells 17.8 cm long and 3.6 cm in diameter. These sand packs were comprised of 170–230 mesh silica sand, and had a porosity ($\phi$) of 0.37. Each sand pack was saturated with Aurignac crude oil and flooded to a cold water residual, such that the initial oil saturation of the sand packs pore volume ($S_{oi}$) was 0.54–0.59 and the initial water saturation ($S_{wi}$) was 0.46–0.41.

In the test of the process of the present invention, crude oil and entrained water produced from steam flooding of the San Ardo field at a pressure of about 550 kPa, and a temperature of about 93°–176° C. was flashed, in a flash drum at a pressure of about 207 kPa for production of a liquid oil phase and a vapor phase comprising steam and steam distilled petroleum vapor. This vapor phase was condensed at a pressure of about 207 kPa and a temperature of about 38° C., producing a condensate which was separated into a water phase and a hydrocarbon condensate phase.

Steam, at a mass flux of 66.42 kg/hr-m$^2$, and hydrocarbon condensate, at a mass flux of 3.11 kg/hr-m$^2$, were combined at a temperature of about 200° C. and injected into the first prepared sand pack while holding a back-pressure of 1,482 kPa on the linear sand pack cell. Flow of this mixture of steam and hydrocarbon condensate was continued for a time sufficient to inject a volume of hydrocarbon condensate equivalent to 0.1 pore volumes ($V_p$) of the sand pack. Upon injection of hydrocarbon condensate equivalent to 0.1 $V_p$, injection of hydrocarbon condensate was terminated, and flow of steam at the rate of 66.42 kg/hr-m$^2$ was continued for a time until production of petroleum from the sand pack ceased. Upon completion of this flooding process, residual oil saturation ($S_{or}$) of the sand pack pore volume was found to be 0.092, compared to initial oil saturation ($S_{oi}$) of 0.54.

For comparison with the process of the present invention, a second sand pack ($\phi = 0.37$, $S_{oi} = 0.55$, $S_{wi} = 0.45$) was flooded with steam, at a temperature of 200° C., a back-pressure of 1,482 kPa, and a steam mass flux of 66.42 kg/hr-m$^2$, for a period until production of petroleum from the sand pack ceased. Upon completion of this steam flood, residual oil saturation ($S_{or}$) of the sand pack pore volume was found to be 0.180.

For comparison with the proess of the present invention, a third sand pack ($\phi = 0.37$, $S_{oi} = 0.59$, $S_{wi} = 0.41$) was flooded with a mixture of steam and $C_5$–$C_6$ naphtha. In this comparison test the third sand pack was flooded with a mixture of steam, at a mass flux of 66.42 kg/hr-m$^2$, and $C_5$–$C_6$ naphtha, at a mass flux of 3.11 kg/hr-m$^2$, at a temperature of about 200° C. and a back-pressure of 1,482 kPa. Flow of this mixture of steam and naphtha was continued for a time sufficient to inject a volume of naphtha equivalent to 0.1 pore volumes ($V_p$) of the sand pack. Upon completion of 0.1 $V_p$ naphtha into the sand pack, injection of naphtha was terminated and injection of steam continued at a mass flux of 66.42 kg/hr-m$^2$ until further production of petroleum from the sand pack ceased. Upon completion of this flooding process, residual oil saturation ($S_{or}$) of the sand pack pore volume was found to be 0.115.

For comparison with the process of the present invention a fourth sand pack ($\phi = 0.37$, $S_{oi} = 0.58$, $S_{wi} = 0.42$) was flooded with steam and a mixture of $C_3$–$C_5$ hydrocarbons in a $C_3$:$C_5$ mole ratio of 23:77 respectively. In this comparison test, steam, at a mass flux of 66.42 kg/hr-m$^2$, and $C_3$–$C_5$ hydrocarbon mixture, at a mass flux of 3.11 kg/hr-m$^2$, were combined at a temperature of about 200° C. and injected into the fourth sand pack while holding a back-pressure of 1,482 kPa on the linear sand pack cell. Flow of steam and $C_3$–$C_5$ hydrocarbon mixture was continued for a time sufficient to inject a volume of $C_3$–$C_5$ hydrocarbon equivalent to 0.1 pore volumes ($V_p$) of the sand pack. Upon injection of 0.1 $V_p$ $C_3$–$C_5$ hydrocarbon mixture into the sand pack, injection of the $C_3$–$C_5$ hydrocarbon mixture was terminated and injection of steam continued at a mass flux of 66.42 kg/hr-m$^2$ until further production of petroleum from the sand pack ceased. Upon completion of this flooding process, residual oil saturation ($S_{or}$) of the sand pack pore volume was found to be 0.144.

Results of this test of the process of the present invention and of the three comparative tests using processes of the prior art are summarized in Table II, below:

TABLE II

| AURIGNAC CRUDE (14.9° (API) TEST | 1 | 2 | 3 | 4 |
|---|---|---|---|---|
| SAND PACK (kPa) | 1482 | 1482 | 1482 | 1482 |
| Back-pressure (psia) | 215 | 215 | 215 | 215 |
| Porosity-$\phi$ (volume pores) / (volume sand pack) | 0.37 | 0.37 | 0.37 | 0.37 |
| Initial oil saturation | | | | |

TABLE II-continued

| AURIGNAC CRUDE (14.9° (API) TEST | 1 | 2 | 3 | 4 |
|---|---|---|---|---|
| $S_{oi}$ (volume oil) / (volume pores) | 0.54 | 0.55 | 0.59 | 0.58 |
| Initial water saturation $S_{wi}$ (volume water) / (volume pores) | 0.46 | 0.45 | 0.41 | 0.42 |
| Injected Hydrocarbon | SAN ARDO Flash conden. | None | $C_5$-$C_6$ naphtha | $C_3$-$C_5$ 23:77 mol. ratio |
| mass flux (kg/hr-m$^2$) | 3.11 | 0 | 3.11 | 3.11 |
| Amount injected ($V_p$) | 0.1 Vp | 0 | 0.1 Vp | 0.1 Vp |
| Injected Steam mass flux (kg/hr-m$^2$) | 66.42 | 66.42 | 66.42 | 66.42 |
| Residual oil saturation $S_{or}$ (vol. oil/vol. pores) | 0.092 | 0.180 | 0.115 | 0.144 |

As can be seen, from Table II, use of the process of the present invention (Test 1) results in substantially less residual oil saturation ($S_{or}$) in the sand pack than the residual oil saturation obtained from use of comparable prior art petroleum recovery methods.

The hydrocarbon condensate employed in the enhanced petroleum recovery process of the present invention is obtained by flashing, or steam distilling, the produced crude oil-water mixture of the process. Thus, the process of the present invention produces its own hydrocarbon solvent for injection, and such hydrocarbon solvent has superior properties for enhancing recovery of petroleum from subterranean formations. These advantages of the present invention have great economic significance in processes for enhanced recovery of petroleum, where costs of operating such recovery processes represent the major portion of the value of recovered petroleum.

EXAMPLE II

In this example, the tests of Example I for the process of the present invention, and the comparative tests of enhanced recovery processes using steam flooding; flooding with $C_5$-$C_6$ range naphtha and steam; and flooding with a $C_3$-$C_5$ mixture in a mol ratio of 23:77 respectively and steam was repeated employing Lombardi crude (10.5°API) from the San Ardo field.

Preparation of the sand packs, flashing of produced crude for obtaining hydrocarbon condensate to be injected according to the process of the present invention, and operation of each flooding test were at the same conditions as used in Example I, with the exception that the sand packs were saturated with Lombardi crude of 10.5° API gravity.

Results of these tests of Example II are summarized in Table III below:

TABLE III

| | LOMBARDI CRUDE (10.5° API) | | | |
|---|---|---|---|---|
| TEST | 1 | 2 | 3 | 4 |
| Sand Pack (kPa) | 1482 | 1482 | 1482 | 1482 |
| Back-pressure (psia) | 215 | 215 | 215 | 215 |
| Porosity $\phi$ (pore volume) / (sand pack vol.) | 0.37 | 0.37 | 0.37 | 0.37 |
| Initial oil Saturation-$S_{oi}$ (volume oil/pore vol.) | 0.54 | 0.60 | 0.54 | 0.56 |
| Initial water saturation $S_{wi}$ (volume water/pore vol) | 0.46 | 0.40 | 0.46 | 0.44 |
| Residual oil saturation $S_{or}$ (vol. oil/pore vol.) | 0.090 | 0.205 | 0.117 | 0.152 |
| Injected Hydrocarbon | SAN ARDO flash Condensate | None | $C_5$-$C_6$ Naphtha | $C_3$-$C_5$ mixture |
| Mass flux (kg/hr-m$^2$) | 3.11 | 0 | 3.11 | 3.11 |
| Amount injected (volume hydrocarbon) / (pore volume) | 0.1 | 0 | 0.1 | 0.1 |
| Injected steam mass flux (kg/hr-m$^2$) | 66.42 | 66.42 | 66.42 | 66.42 |

As can be seen from Table III, use of the process of the present invention (Test 1) results in substantially less residual oil saturation ($S_{or}$) in the sand pack than is obtained employing the comparable enhanced recovery processes of the prior art. The reduced residual oil saturation ($S_{or}$) for the process of the present invention represents improved recovery of petroleum. Consequently, the process of the present invention is shown to be advantageous over processes of the prior art when used to recover the 10.5° API Lombardi crude.

FIELD TEST

The enhanced petroleum recovery process of the present invention is applied in a field test as described below. Steam is injected into a petroleum bearing formation via an injection well for a time sufficient for a steam front and an associated bank of petroleum to reach a production well. A hot mixture of petroleum and water rise in the production wellbore, a portion of the hot water flashes to steam, thereby steam distilling a light hydrocarbon vapor fraction from the petroleum. At the production well head, vapor from the wellbore is separatedfrom produced liquid, and the vapor is condensed in a condenser. Condensate from the condenser is separated under the influence of gravity in a receiver vessel to form a hydrocarbon phase and water phase. Hydrocarbon phase from the receiver is injected with additional steam into the injection well for production of additional petroleum from the petroleum bearing formation.

It is to be understood that modifications and variations of the process described in the foregoing specification will occur to those skilled in the art, which modifications and variations are within the spirit and scope of the present invention. Consequently, the only limitations of the present invention intended are those included in the appended claims.

We claim:

1. In a process for recovery of petroleum from a subterranean formation wherein steam is injected via an injection well into said subterranean formation, wherein petroleum is produced via a production well from said formation, wherein injection of steam into said formation is continued until a steam front reaches said production well such that steam condensate in admixture with petroleum enters the bore of said production well, the improvement which comprises:

a. flashing within said production well bore, said mixture of petroleum and steam condensate produced from said formation at a pressure less than the pressures of said formation for production of a vapor phase comprising steam and light hydrocarbons and a liquid phase comprising petroleum;

b. separating said vapor phase from said liquid phase; and c. injecting at least a portion of said separated vapor phase with additional steam, into said formation, via said injection well, for enhancing production of petroleum from said formation via said production well.

2. The process of claim 1 wherein the amount of light hydrocarbon contained in the portion of said vapor phase injected into said formation is equivalent toabout 1–100 percent of the total pore volume of that portion of the formation through which the steam and light hydrocarbon flow to said production well.

3. The process of claim 2 wherein the light hydrocarbon and additional steam injected into said formation are at an injection pressure sufficient to force a flow of steam, light hydrocarbon and petroleum toward said production well, and are at a temperature sufficient to maintain the additional steam completely in the vapor phase at said injection pressure.

4. A process for recovering petroleum from a subterranean formation, which process comprises:

a. injecting steam into said formation via an injection well;

b. producing petroleum from said formation via a production well;

c. continuing injection of said steam and production of said petroleum until communication between said injection well and said production well is established through said formation such that a mixture of petroleum and steam condensate enters the bore of said production well;

d. flashing, in a flash zone, said mixture of petroleum and steam condenstate for production of a vapor phase comprising steam and light hydrocarbon, and production of a liquid phase comprising petroleum;

e. condensing, in a condensing zone, said vapor hase for production of a condensate comprising water and condensed hydrocarbon;

f. separating, in a gravity separation zone, said condensate into a water phase and a hydrocarbon phase;

g. injecting said condensed hydrocarbon with additional steam into said formation, via said injection well, for enhancing recovery of additional petroleum from said formation.

5. The process of claim 4 wherein the liquid volume ratio of injected condensed hydrocarbon to additional steam is in the range of about 1:1 to about 1:100, and wherein the volume of injected condensed hydrocarbon is equivalent to about 1–100 percent of the pore volume of that portion of the formation swept by the injected hydrocarbon and additional steam.

6. The process of claim 5 wherein liquid volume ratio of injected hydrocarbon to additional steam is about 1:20, and wherein the volume of injected condensed hydrocarbon is equivalent to about 5–20 percent of the pore volume of that portion of the formation swept by the injected hydrocarbon and additional steam.

7. The process of claim 5 wherein, upon completion of injection of condensed hydrocarbon, the flow of additional steam is maintained for production of additional petroleum from said formation.

* * * * *